US005861045A

United States Patent [19]

Hall

[11] Patent Number: 5,861,045

[45] Date of Patent: Jan. 19, 1999

[54] METHOD OF DYEING TEXTILES

[75] Inventor: David Hall, 1784 Lauren La., Auburn, Ala. 36830

[73] Assignees: John Lezdey, Voorhees, N.J.; David Hall, Auburn, Ala.

[21] Appl. No.: 832,368

[22] Filed: Apr. 2, 1997

[51] Int. Cl.[6] ..... D06P 1/653; D06P 1/673; D06P 1/34

[52] U.S. Cl. ..... 8/595; 8/623; 8/485; 8/653; 8/646; 8/918; 8/596

[58] Field of Search ..... 8/595, 623, 918, 8/921, 485, 596, 438, 439, 646, 653

[56] References Cited

U.S. PATENT DOCUMENTS

| | | | |
|---|---|---|---|
| 60,148 | 12/1866 | Davies | 8/595 |
| 768,809 | 8/1904 | Lawson | 8/595 |
| 1,321,972 | 11/1919 | Bolz | 8/595 |

FOREIGN PATENT DOCUMENTS

| | | | |
|---|---|---|---|
| 3522 | of 1883 | United Kingdom | 8/595 |
| 12490 | of 1884 | United Kingdom | 8/595 |
| 166337 | 7/1921 | United Kingdom | 8/595 |
| 231209 | 3/1925 | United Kingdom | 8/595 |

OTHER PUBLICATIONS

Knecht et al *Manual of Dyeing: For The Use of Practical Dyers, Manufacturers, Students and All Interested in the Art of Dyeing*, 9th edition, vol. pp., 179, 184–190–262–264, 1945.

Hummel, *Mordants, Methods and Machinery Used in Dyeing*, pp. 80–81, Nov. 1906.

Lyman Fourt et al, "The Improvement of Luster of Cotton Part XI: Dyes and Luster", Textile Research Journal, vol. XXV, #4 Apr. 1955.

*Primary Examiner*—Margaret Einsmann
*Attorney, Agent, or Firm*—John Lezdey

[57] ABSTRACT

There is provided a method of dyeing cellulosic and/or wool fibers and fabrics in a dyebath containing a dilute solution of tannic acid and/or tannic acid containing products at a proper pH. An exhaust salt is added to the bath to exhaust the tannic acid and then the tannic acid is fixed with an iron salt.

11 Claims, No Drawings

METHOD OF DYEING TEXTILES

FIELD OF THE INVENTION

The present invention relates to a novel method of dyeing textiles to various black shades with non-polluting coloring methods. More particularly, there is provided a method of dyeing cellulose or wool containing textiles utilizing tannic acid and tannic acid containing products.

BACKGROUND OF THE INVENTION

It has been known that basic dyes can be fixed onto cotton by making use of a tannin mordant. The usual mordant comprises tannic acid that has been insolubilized with tarter emetic (basic antimony oxide). The resulting antimony tannate is employed to fix a basic dye onto the cellulose (which is thought to be as an insoluble color lake). In the mordanting process the water utilized must be absolutely free of any iron or the shades are adversely affected, being duller as the result of the reaction of the tannin to form black complexes (See for example J.M. Matthew's, *Application of Dyestuffs to Textiles, Paper, Leather and Other Materials,* Wiley, 1920).

The prior process for mordanting of textile goods, specifically cotton cellulose is not presently being employed because the antimony salts are highly poisonous in nature and therefore have ecological concerns for the environment. The treated fabrics needed to be rigorously washed in order to remove any unfixed antimony otherwise blood poisoning could result when the fabrics were worn next to the skin. Again antimony salts in the wash effluent gives rise to environmental concerns.

Today's consumers are quite aware of the environment and the problems that are associated with the coloration of textiles with synthetic dyestuffs. There appears to be a genuine desire on the part of the consumer to obtain textiles that have their coloration obtained with natural and/or non polluting dyeing materials, methods and procedures.

At the present time, sulfur dyes are primarily utilized to obtain a black color on cellulosic goods. C.I. Sulfur Black 1 is one of the most widely used dyes in the world for this purpose. Sulfur dyes are intrinsically insoluble, but they dissolve in solutions of alkaline reducing agents from which they are substantive to cellulosic materials. Once on the fiber, they must be converted back to their insoluble pigmentary form by oxidation.

Some of the problems with sulfur dyed goods is a phenomena known as bronzing as well as acid tendering. In severe conditions of heat and humidity or with improper oxidation, some sulfur dyeings, notably black, can generate a small amount of sulfuric acid within cellulosic fibers leading to tendering.

SUMMARY OF THE INVENTION

According to the invention, there is provided a method for dyeing textiles, particularly those textiles having cellulosic fibers by treating the textiles in a dyebath comprising tannic acid and/or a tannic acid containing product. It is recognized that hair fibers can also be treated emphasizing this process, but the tannic acid needs to be applied under near neutral conditions. Salt is generally not needed since the tannic acid has a higher affinity for wool than cellulose.

More particularly, the invention provides a process for dyeing textile fibers or fabrics which comprises the steps of: a) treating the fibers or fabrics in a bath containing tannic acid or a tannic acid producing product at an alkaline pH (except for wool) and elevated temperatures, (or at room temperature overnight) b) adding an exhaust salt to said bath and then c) fixing said fibers or fabrics in a bath containing iron salts.

Advantageously, the tannic acid is fixed in the fibers or fabric without the use of antimony salts.

Preferably, the dye bath is at a temperature below 200° F.

DESCRIPTION OF THE PREFERRED EMBODIMENTS

According to the invention, it is possible to avoid the prior art problems in the production of solid black shades on 100% cotton, viscose rayon, linen and other cellulosic goods by entirely avoiding the antimony salts (tartar emetic) that was once employed to fix the tannic acid in the fabric. We have found that the cotton can be treated for as little as 30 minutes at about 150° F. with about 1 to 10% by weight preferably about 3–5% Tannic Acid in which about 10–15% salt (Sodium Chloride or glauber salts) is added on weight of the goods (OWF). The goods are then extracted to remove excess liquid and the goods are then fixed in a bath containing about 2–15% by weight, preferably about 5–10% iron salts (ferric chloride, ferric sulfate, ferric acetate or the like). In the manner, an intense black shade is obtained which has excellent fastness properties. If desired the goods can be over dyed with a basic black or basic green dye to improve the intensity of the black shade obtained. This process is quite well suited to the dyeing of either yarns, fabrics or garments.

Other natural products such as extract of sumac leaves, myrabolans or Chinese galls will give the same results. In fact, the myrabolans appear to give a more intense black than does the tannic acid alone. Hence, a mixture of the two products is the preferred embodiment for obtaining fast black shades on textile fabrics or yarns without the use of synthetic dyes.

When desired, the amount of tannic acid employed can be reduced and fixed with iron salts to give a gray bottom which can be used to dull the shade of the overdyed goods. This eliminates the need to use sulfur dyes such as is presently used when attempting to obtain a gray bottom to be topped with indigo such as is used in the production of dark indigo shades on denim fabrics.

When treating cellulosic fibers, the dyebath may be made alkaline utilizing any of the conventional bases, for example sodium hydroxide, potassium hydroxide, soda ash or sodium phosphates. Generally, about 0.5 to 10% on weight fabric (OWF) of potassium or sodium hydroxide is preferably utilized. When dyeing hair fibers, the bath should be neutral or only slightly alkaline. The alkalinity can be higher than 7 if cold, overnight treatments are utilized.

A dyeing temperature of about 100° to 190° F., preferably about 150° to 180° F. has been found to be suitable. Alternatively, the goods can be treated at room temperature overnight.

It has also been found that the iron salt employed is important since other shades ranging from blue to blue/black can be obtained depending upon the iron salt employed. For example, iron napthenate gives a bluer black than does the ferric chloride. Almost any water soluble iron compound or reagent can be employed for the color development. The iron can be in its Fe II or Fe III state. Those compounds that have been found suitable include but are not limited to: ferric and ferrous chloride, ferric and ferrous sulfate, ferric and ferrous nitrate, ferric citrate, ferric formate, ferrous iodide, ferric malate, ferrous and ferric lactate, ferric oxalate, ferric and ferrous thiocyanate and iron napthenate.

The process of the invention can be used in a two bath system or a single bath system. Either method provides good color yield.

The present invention will now be explained in detail by reference to the following non-limiting examples. Unless otherwise indicated, all percentages are by weight.

EXAMPLE 1

Five grams of a 100% bleached cotton twill bottom weight fabric was placed in a dyebath containing 5% OWF of tannic acid at pH 9, for 30 minutes at 180° F. Fifteen (15)% Salt (Nacl) was added OWF in 5% increments over the next 15 minutes. The dyebath was cooled to 140° F. and dropped and the fabric was spun damp dry. A solution of 2.5% ferric chloride was added and the goods were agitated for 15 minutes and rinsed. The black color development was immediate. Upon drying the fabric was dyed to a deep black shade.

EXAMPLE 2

The conditions of Example 1 was repeated except that myrabolan was employed instead of the tannic acid. Upon drying the fabric, an intense black shade was obtained.

EXAMPLE 3

The conditions of Example 1 was employed except Sumac extract was employed instead of the tannic acid. Upon drying the fabric, an intense black shade was obtained.

EXAMPLE 4

The conditions of Example 1 was employed except Chinese Gall extract was employed instead of the tannic acid. Upon drying the fabric, an intense black shade was obtained.

EXAMPLE 5

The conditions of Example 1 was employed except that the dyeing was done at room temperature overnight prior to treatment with Iron. Upon drying the fabric, an intense black shade was obtained.

EXAMPLE 6

The conditions of Example 1 was employed except that an equal parts mixture of tannic acid and myrabolan was employed instead of the 100% tannic acid. Upon drying the fabric, an intense black shade was obtained.

EXAMPLE 7

The conditions of Example 1 was employed except the temperature was reduced to 150° F. and the dyeing time was only 30 minutes, the salt being added after 15 minutes dyeing time. Upon drying the fabric, an intense black shade was obtained.

EXAMPLE 8

The fabric in Example 1 was steeped in 5% OWF solution at room temperature overnight (12 hours). The solution was dropped and the fabric spun to damp dry. A solution of ferric sulfate was added and the fabric stirred for 10 minutes. Color development was immediate. After rinsing and drying the fabric was dyed to a deep black color.

EXAMPLE 9

A blended fabric containing 50% cotton and 50% polyester in an intimate blend was treated under the conditions of Example 1. Upon drying the fabric had a dark charcoal color. Further, only the cotton portion of the blend was dyed.

EXAMPLE 10

A blended fabric containing 35% cotton and 65% polyester in an intimate blend was treated under the conditions of Example 1. Upon drying the fabric had a lighter charcoal color than was found in Example 9. Further, only the cotton portion of the blend was dyed.

EXAMPLE 11

The conditions of Example 1 was employed except that a 100% prepared Viscose rayon fabric was employed instead of the cotton fabric. Upon drying the fabric, an intense black shade was obtained.

EXAMPLE 12

The conditions of Example 1 was employed except that a 100% bleached linen fabric was employed instead of the cotton fabric. Upon drying the fabric, an intense black shade was obtained.

EXAMPLE 13

The conditions of Example 1 was employed except that a 100% cotton and 100% polyester woven in such a manner so as to give a stripped weave pattern was employed instead of the 100% cotton fabric. Upon drying the fabric, an intense black shade was obtained only on the cotton portion of the weave to give a fabric having black and white stripes. Thus styling effects can be obtained by using cellulosic components with those fibers not dyed by the tannic acid/Iron system.

EXAMPLE 14

100% raw cotton yarn of the type typically employed for denim fabrics was dipped for 30 seconds into a hot (180° F.) solution containing 3% OWB of tannic acid and squeezed to give a 75% wet pickup. The yarn was then padded into a cold (room temperature) solution containing 2.5% ferric chloride for 25 seconds, followed by squeezing to remove excessive liquor. The yarn had a dark charcoal gray color. The yarn was then alternately padded 7 time into a solution containing reduced indigo solution followed by skying in the manner normally employed for deep blue shades on denim. Upon drying the fabric had a much darker blue shading than did analogous yarn in which the tannic acid/iron treatment was omitted. Thus this process can be used instead of the sulfur black system presently employed to produce these styling affects but without the environmental problems associated with sulfur dyeing systems.

EXAMPLE 15

A sample of the dyed fabric from Example 1 was redyed with a 2% solution of CI Basic Green 1. The shade after rinsing and drying was an intense black color that had a greenish hue. This illustrates that the basic dye had an affinity for the iron emetic.

EXAMPLE 16

The process of Example 7 in which a 5 gram sample of worsted wool is substituted for the cotton swatch and the treatment bath is at a pH of 7.0 .After rinsing and drying the wool was dyed a deep black shade. This illustrates that the process is also applicable to hair type fibers.

EXAMPLE 17

A 5 gram sample of a woven 100% cashmere suiting fabric was immersed in a solution of 5% tannic acid OWF at a pH of 7 and at room temperature for 12 hours. The goods were spun damp and treated in a solution of 2.5% ferric chloride OWF for 10 minutes. After rinsing and drying the fabric had been dyed to a deep black shade.

EXAMPLE 18

A 5 gram swatch of a blended coat fabric containing 80% wool and 20% cashmere was treated as in claim 1 except that the pH was maintained at 7.0 during the dyeing. After rinsing and drying the fabric was dyed a deep black shade.

What is claimed is:

1. In a process for dyeing cellulosic textile fibers or fabrics black which is free of antimony salts, the improvement which comprises the steps of:

a. treating the fibers or fabrics in a dyebath containing a dilute solution of containing a member selected from the group consisting of tannic acid and tannic acid containing products at a pH greater than 8, said solution being made alkaline with a base selected from the group consisting of sodium hydroxide and potassium hydroxide, b. adding an exhaust salt to exhaust said tannic acid, and then c. treating the fibers or fabric from step a in a separate bath containing an iron salt selected from the group consisting of iron chloride and iron sulfate, whereby the fibers or fabric from step c have a black shade.

2. The process of claim 1 wherein step a is at a temperature of about 100° to 190° C.

3. The process of claim 1 wherein said exhaust salt is sodium chloride or glaubers salt.

4. The process of claim 1 wherein about 1 to 10% by weight of tannic acid is present in said dyebath.

5. The process of claim 4 comprising about 3 to 5% by weight of tannic acid.

6. The process of claim 1 comprising about 2 to 15% by weight of iron salt.

7. The process of claim 1 including the further steps of dyeing said fiber or fabric in a second dyebath.

8. The process of claim 1 wherein said tannic acid containing product is selected from the group consisting of sumac leaf extract, myrabolans extract and Chinese galls extract.

9. The process of claim 1 wherein the fabric is steeped in the tannic acid bath overnight at room temperature prior to treatment in the iron salt.

10. The process of claim 1 wherein the dyed fabric is subsequently overdyed with Indigo.

11. The process of claim 1 wherein the dye fabric is subsequently overdyed with a Basic Dye.

* * * * *